US009889955B2

(12) United States Patent
Murray

(10) Patent No.: US 9,889,955 B2
(45) Date of Patent: Feb. 13, 2018

(54) APPARATUS AND METHOD FOR PACKAGING FLAT PRODUCTS

(71) Applicant: Pouch Pac Innovations, LLC, Sarasota, FL (US)

(72) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 819 days.

(21) Appl. No.: 14/153,663

(22) Filed: Jan. 13, 2014

(65) Prior Publication Data

US 2014/0196408 A1 Jul. 17, 2014

Related U.S. Application Data

(60) Provisional application No. 61/751,427, filed on Jan. 11, 2013.

(51) Int. Cl.

| | |
|---|---|
| ***B65B 25/06*** | (2006.01) |
| ***B65B 5/06*** | (2006.01) |
| ***B65B 31/04*** | (2006.01) |
| ***B65B 35/30*** | (2006.01) |
| ***B65B 43/46*** | (2006.01) |
| ***B65B 45/00*** | (2006.01) |
| ***B65B 67/00*** | (2006.01) |
| ***B65B 35/52*** | (2006.01) |
| ***B65B 61/24*** | (2006.01) |

(52) U.S. Cl.

CPC ..... *B65B 25/065* (2013.01); *B65B 5/067* (2013.01); *B65B 31/042* (2013.01); *B65B 35/52* (2013.01); *B65B 61/24* (2013.01); *B65B 43/465* (2013.01)

(58) Field of Classification Search

CPC ..... B65B 25/065; B65B 5/067; B65B 31/042; B65B 35/30; B65B 43/465; B65B 45/00; B65B 67/00

USPC ..... 53/251, 475, 531, 537, 540

See application file for complete search history.

(56) References Cited

U.S. PATENT DOCUMENTS

| | | | | |
|---|---|---|---|---|
| 1,915,489 A * | 6/1933 | Gere | B65B 39/007 | 53/262 |
| 2,736,477 A * | 2/1956 | Krebs | B65B 67/04 | 53/260 |
| 3,022,620 A * | 2/1962 | Gallet | B65B 5/061 | 53/136.5 |
| 3,675,389 A * | 7/1972 | Uline | B65B 5/04 | 198/382 |

(Continued)

*Primary Examiner* — Andrew M Tecco
*Assistant Examiner* — Praachi M Pathak
(74) *Attorney, Agent, or Firm* — Dinsmore & Shohl LLP

(57) ABSTRACT

A method and apparatus for packaging patties or other similarly shaped items into a flexible pouch. The method comprising the steps of stacking a plurality of patties by a stacker, the patties stacked on top of one another, lowering the plurality of patties into a flexible pouch, vacuuming the air out of the flexible pouch to seal the pouch, the vacuum creating an air tight seal and forming a pair of frangible or solid seals in the pouch, the frangible seals positioned adjacent to the plurality of patties. The apparatus for packaging patties into a flexible pouch, the apparatus comprising a stacker, a patty holder, a vacuum is further positioned adjacent to the patty holder, the vacuum operable to remove the air from the flexible pouch. A frangible seal creator is also provided operable to create a frangible seal on the flexible pouch.

15 Claims, 5 Drawing Sheets

(56) References Cited

U.S. PATENT DOCUMENTS 3,866,741 A * 2/1975 Carbon ..... B65G 57/11 198/402
3,927,508 A * 12/1975 Campbell, III ..... B65B 35/44 198/408
3,959,951 A * 6/1976 Paules ..... B65B 57/12 414/789.5
3,968,629 A * 7/1976 Gidewall ..... B65B 25/067 53/374.8
4,035,982 A * 7/1977 Paules ..... B65B 1/46 53/138.3
4,048,784 A * 9/1977 Toby ..... B65B 25/065 198/468.6
4,086,745 A * 5/1978 Caudle ..... B65B 35/50 53/540
4,112,124 A * 9/1978 Jarvis ..... A61L 2/10 426/107
4,159,761 A * 7/1979 Egee ..... B65B 5/101 271/189
4,364,467 A * 12/1982 Blakelock ..... B65G 47/904 198/409
4,405,186 A * 9/1983 Sandberg ..... B26D 7/32 271/218
4,421,222 A * 12/1983 Stuermer ..... B65G 47/1492 198/382
4,627,215 A * 12/1986 Walz ..... B65B 5/101 198/346.2
4,955,794 A * 9/1990 Fluck ..... B65B 23/14 414/790
5,095,684 A * 3/1992 Walker ..... B65B 57/12 198/462.2
5,279,096 A * 1/1994 Mims ..... B65B 23/16 53/251
5,310,306 A * 5/1994 Lunghi ..... B65B 25/065 294/81.52
5,398,479 A * 3/1995 Diete ..... B65B 5/06 53/258
5,675,963 A * 10/1997 Nicholson ..... B65B 35/50 53/247
5,809,745 A * 9/1998 Reinert ..... B65B 35/50 53/258
6,231,905 B1 * 5/2001 DelDuca ..... B65B 31/06 426/118
6,434,912 B1 * 8/2002 Walz ..... B65B 23/16 198/418.6
6,438,925 B1 * 8/2002 Straub ..... B65B 5/108 53/244
6,543,989 B1 * 4/2003 Derenthal ..... B65B 23/14 414/790
6,606,841 B1 * 8/2003 Germunson ..... B65B 5/068 294/27.1
6,845,860 B1 * 1/2005 Walker ..... B65G 47/53 198/433
6,868,651 B1 * 3/2005 Sorensen ..... B65B 5/065 294/119.1
7,591,124 B2 * 9/2009 Ruz ..... B65B 5/067 53/447
8,407,973 B2 * 4/2013 Finkowski ..... A21C 9/086 53/247
8,931,240 B2 * 1/2015 Lindee ..... B25J 9/0093 53/251
9,421,693 B2 * 8/2016 Baechtold ..... B26D 7/0675
2002/0148203 A1 * 10/2002 Waddell, II ..... B65B 5/105 53/446
2002/0182050 A1 * 12/2002 Hart ..... B65B 5/10 414/789.9
2004/0182469 A1 * 9/2004 Concetti ..... B65B 1/02 141/10
2005/0262815 A1 * 12/2005 Kuss ..... B65B 9/20 53/552
2007/0090590 A1 * 4/2007 Doery ..... B65H 31/14 271/213
2007/0119125 A1 * 5/2007 Stenbom ..... B65B 5/105 53/473
2007/0241151 A1 * 10/2007 Murray ..... B65B 43/465 224/407
2007/0251193 A1 * 11/2007 Van Ballegooijen ... B65B 5/105 53/475
2008/0110723 A1 * 5/2008 Yan Ruz ..... B65B 5/067 198/347.1
2012/0279180 A1 * 11/2012 Crawford ..... B65B 57/00 53/432
2014/0053511 A1 * 2/2014 Malenke ..... B65B 23/12 53/473
2014/0196408 A1 * 7/2014 Murray ..... B65B 25/065 53/447

* cited by examiner

APPARATUS AND METHOD FOR PACKAGING FLAT PRODUCTS

CROSS-REFERENCE TO RELATED APPLICATIONS

This application claims priority of U.S. Provisional Patent Application Ser. No. 61/751,427 filed Jan. 11, 2013, which is incorporated herein by reference in the entirety.

FIELD OF THE INVENTION

This invention relates generally to packaging. More particularly, this invention relates to an apparatus for packaging hamburger patties in a vacuum sealed pouch.

BACKGROUND OF THE INVENTION

It is well known in the art to stack hamburger patties prior to packaging by hand. These hamburger stackers include a conveyor belt and stacker operable to sack and transport a sack of hamburger patties. However, during transportation or manipulation of the package containing the hamburger patties, it is common for the hamburger patties to become un-stacked within the package. Accordingly, there exists a need in the art to provide an apparatus and method for stacking hamburger patties and keeping the hamburger patties stacked during transportation and use by the consumer.

SUMMARY OF THE INVENTION

A method and apparatus for packaging patties or similar flat items such as food items, disc . . . etc. into a flexible pouch. The method comprising the steps of stacking a plurality of patties by a stacker, the patties stacked on top of one another, lowering the plurality of patties into a flexible pouch, vacuuming the air out of the flexible pouch to seal the pouch, the vacuum creating an air tight seal and forming a pair of frangible seals in the pouch, the frangible (or solid) seals positioned adjacent to the plurality of patties. The method further comprising the step of raising the patties from a first position to a second position before lowering the plurality of patties into the flexible pouch. The method further comprising the step of moving the patties to the stacker by means of a conveyor belt.

The apparatus for packaging patties into a flexible pouch, the apparatus comprising a stacker, the stacker having two side members operable to lift a plurality of patties received from a first conveyor. The apparatus further including a patty holder, the patty holder positioned adjacent to the stacker, the patty holder having two side members operable to lower the plurality of patties into a flexible pouch. A vacuum is further positioned adjacent to the patty holder, the vacuum operable to remove the air from the flexible pouch. A frangible seal creator is also provided operable to create a frangible seal on the flexible pouch. The stacker includes a biasing member extending between the pair of side members. The pair of side members each include a lower bracket to hold the plurality of patties. The vacuum includes a free end having an elongated rod having a plurality of apertures in fluid communication with both the vacuum and the interior of the flexible pouch. A gripper is further provided to hold the flexible pouch in an open position.

DETAILED DESCRIPTION OF THE INVENTION

The present invention provides for a method and apparatus for stacking, storing and sealing hamburger patties within a pouch. The apparatus for packaging patties into a flexible pouch, the apparatus comprising a stacker, the stacker having two side members operable to lift a plurality of patties received from a first conveyor. The apparatus further including a patty holder, the patty holder positioned adjacent to the stacker, the patty holder having two side members operable to lower the plurality of patties into a flexible pouch. A vacuum is further positioned adjacent to the patty holder, the vacuum operable to remove the air from the flexible pouch. A frangible seal creator is also provided operable to create a frangible seal on the flexible pouch. The stacker includes a biasing member extending between the pair of side members. The pair of side members each include a lower bracket to hold the plurality of patties. The vacuum includes a free end having an elongated rod having a plurality of apertures in fluid communication with both the vacuum and the interior of the flexible pouch. A gripper is further provided to hold the flexible pouch in an open position.

Figure 1:
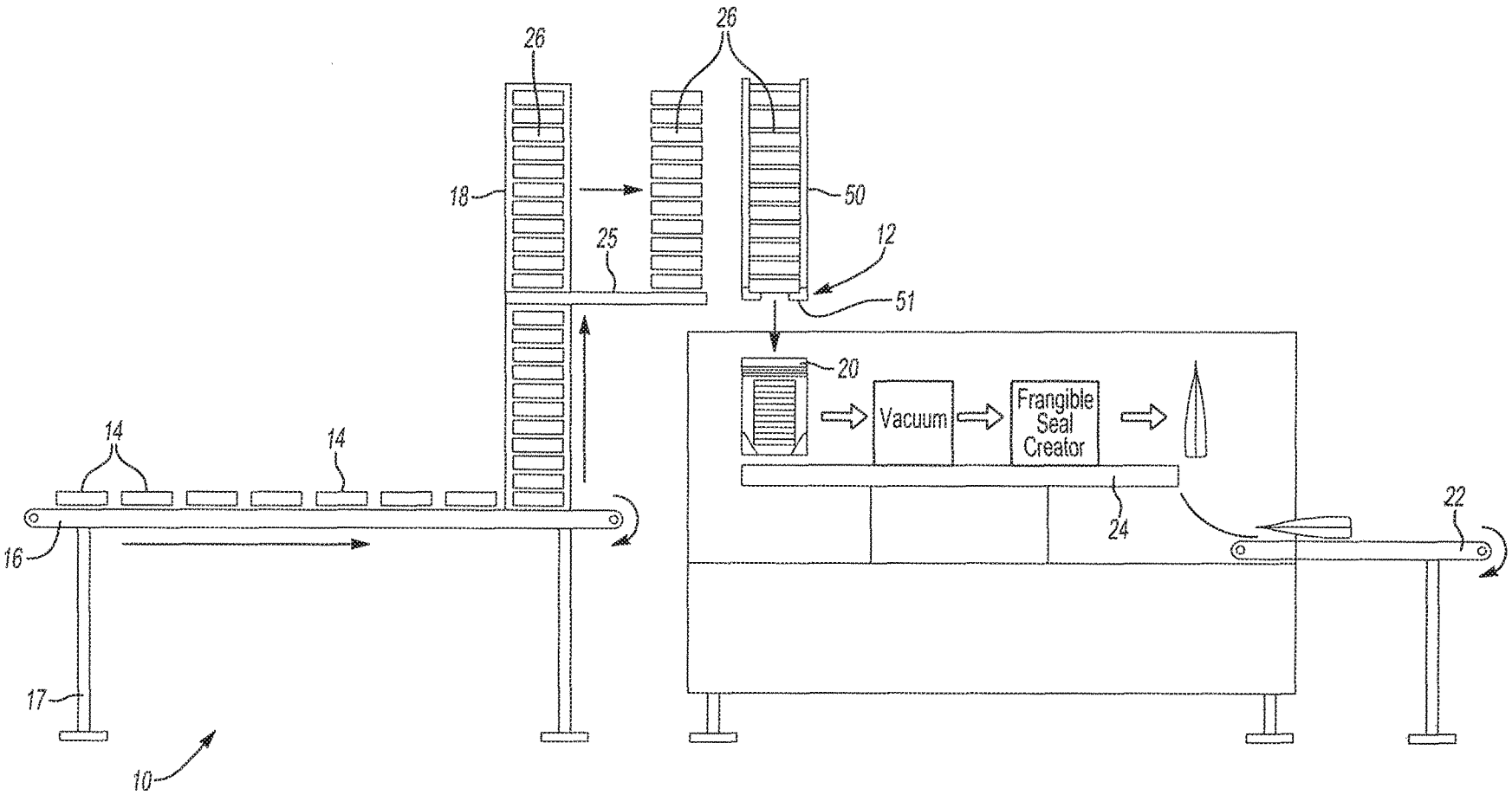
FIG. 1 illustrates a side view of the process and apparatus for hamburger filling into a pouch.

FIG. 1 illustrates the process of taking the hamburger patties to a stacked position and then to a packaged state. The assembly line 10 includes the packaging apparatus 12 for packaging and sealing the hamburger patties 14. The conveyor 16 is supported by legs 17. The conveyor 16 moves the hamburger patties 14 down the conveyor 16 to the stacker 18.

The stacker 18 is operable to stack the hamburger patties 14 into a stacked position arranging the hamburger patties on top of one another into a stack of hamburger patties 14 of two to twenty patties. In the present embodiment, a stack 26 consists of eleven hamburger patties 14. The stacker 18 then moves the stack 26 to an upper platform 25. The stack is moved along the platform to the filling apparatus 12. The stack 26 is held by a hamburger patty holder 50. The hamburger patty holder 50 is operable to securely hold and transport the stack 26. The stacker 18 is operable to lift the patties and simultaneously stack as the patties 14 move along the conveyor belt 16.

The hamburger patty holder 50 further includes an inward protrusion 51 located at a lower end of hamburger patty holder 50.The hamburger patty holder 50 is made of two elongated rods operable to hold the stack 26 between the two rods. The rods, at a lower end, include the inward protrusions 51 which define supporting portions to prevent the stack 26 from falling out of the bottom between the two rods of the hamburger patty holder.

Figure 2:
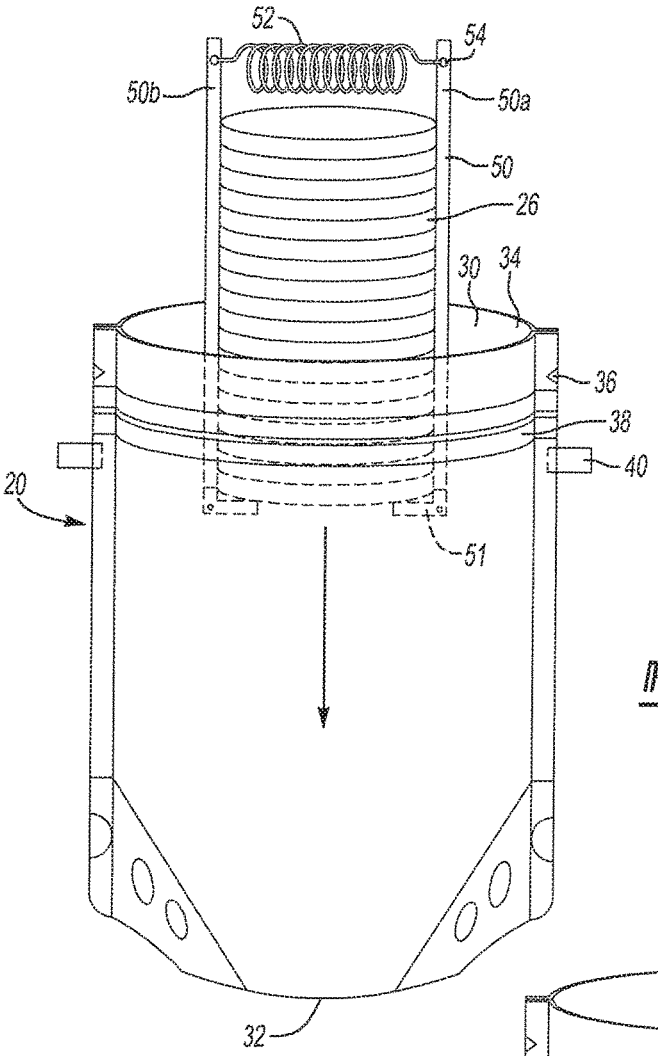
FIG. 2 illustrates a frontal perspective view of the hamburger patty holder and stack of hamburger patties inserted into a hamburger patty pouch.
Figure 3:
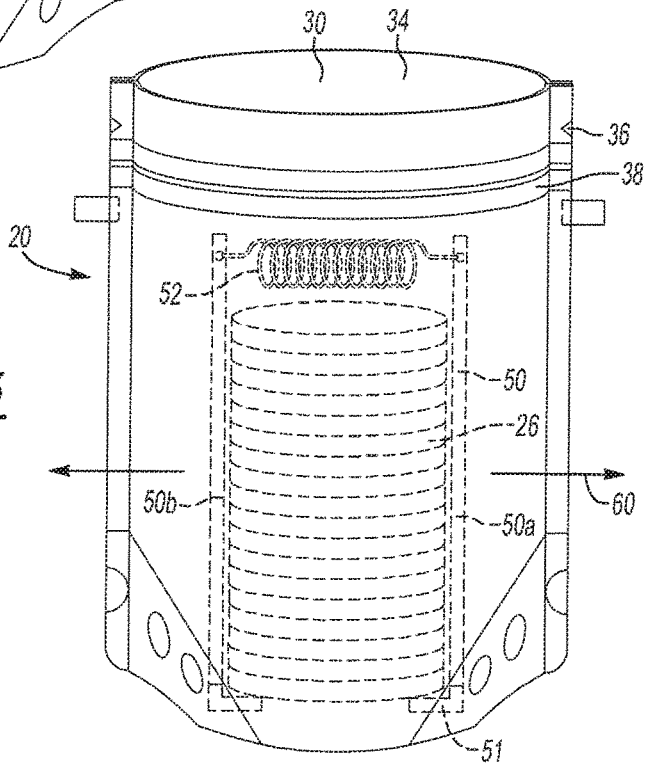
FIG. 3 illustrates a frontal perspective side view of the hamburger patty holder and the hamburger patties held in place inside the pouch.
Figure 4:
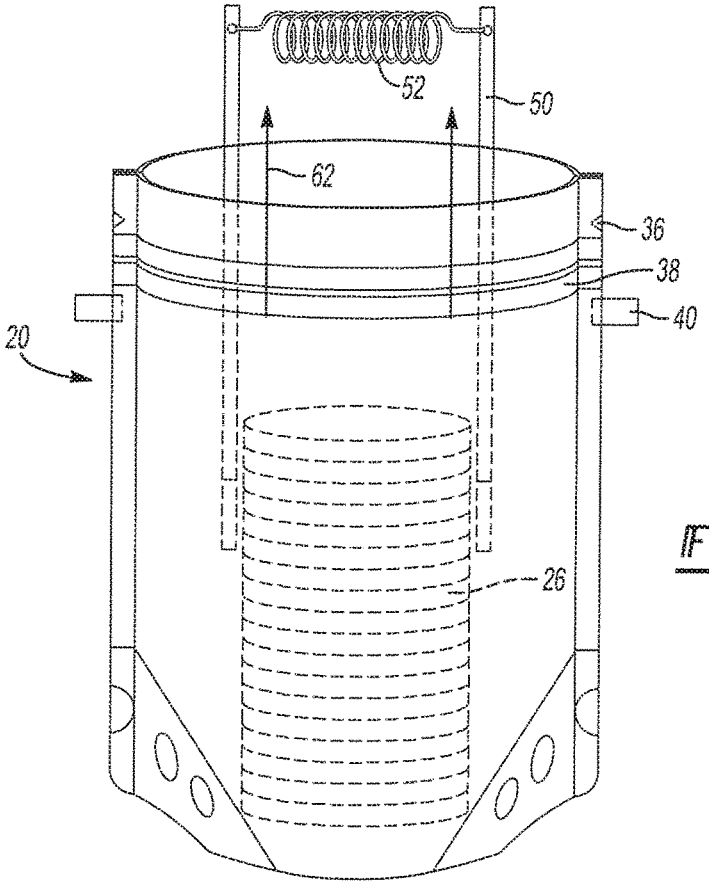
FIG. 4 illustrates a frontal perspective view of the hamburger patty holder releasing the hamburger patty within the pouch.

FIGS. 2 and 3 illustrate the pouch of the present invention operable to accept the stack 26 of the hamburger patties 14. The pouch 20 includes an upper end 30 and a lower end 32, The upper end 30 includes an opening 34 wherein the stack 26 of hamburger patties 14 is inserted into. The pouch 20 further includes tear notches 36 and a pressed to close zipper 38. A gripper 40 is utilized to hold the pouch 20 in an open position. The gripper 40 allows the opening 34 at the first end 30 of the pouch 20 to remain in an open position allowing for the hamburger patty holder 50 to insert the stack 26 into the opening 34 of the pouch 20.

FIGS. 4-7 illustrate the hamburger patty holder 50 inserting the stack 26 into the pouch 20. FIGS. 4-7 illustrate the insertion and removal of the hamburger patty stacker 50 into the pouch 20. The hamburger patty holder 50 includes a biasing member 52 connecting between a rod 50*a* and a second rod 50*b* of the hamburger holder 50. The biasing member 52 is connected at a connection point 54. In the present embodiment, the biasing member is a spring. The hamburger patty holder 50 further includes the protrusions 51 located at a lower end of the rods 50*a*, 50*b* of the hamburger patty holder 50.

Figure 6:
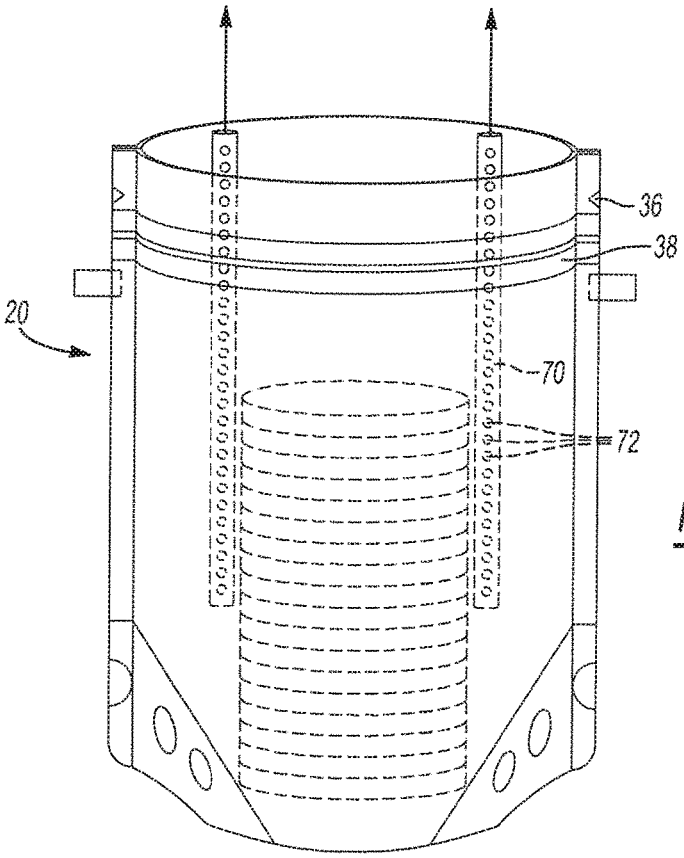
FIG. 6 illustrates a frontal perspective view the vacuum rods being removed from the pouch.
Figure 7:
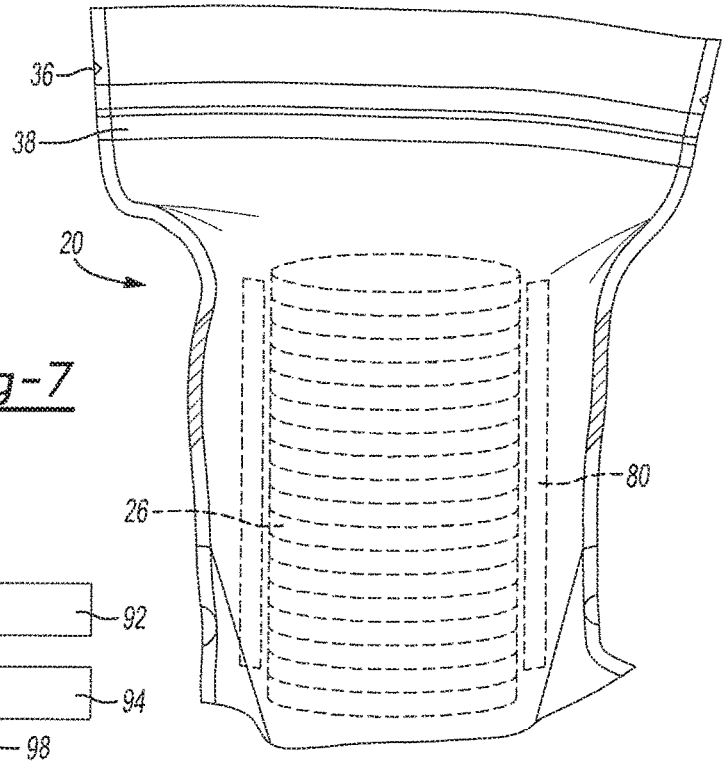
FIG. 7 illustrates a perspective view of a pouch having a frangible seal on either side of the stack of hamburger patties.

The pouch 20 is held in an open position by means of the grippers 40. The hamburger patty stacker 50 is inserted into the opening 34 of the pouch 20. The hamburger patty stacker 50 is lowered into the pouch 20 at the opening 30. FIG. 6 illustrates the release of the hamburger patty holder 50. The rods 50*a*, 50*b* are separated 60 away from the stack 26. As the rods 50*a*, 50*b* are spaced away from the stack 26, the stack 26 rests on a lower portion of the pouch 20. Once the stack 26 is in place within the pouch 20, the hamburger patty holder 50 is removed 62 from the pouch 20.

Figure 5:
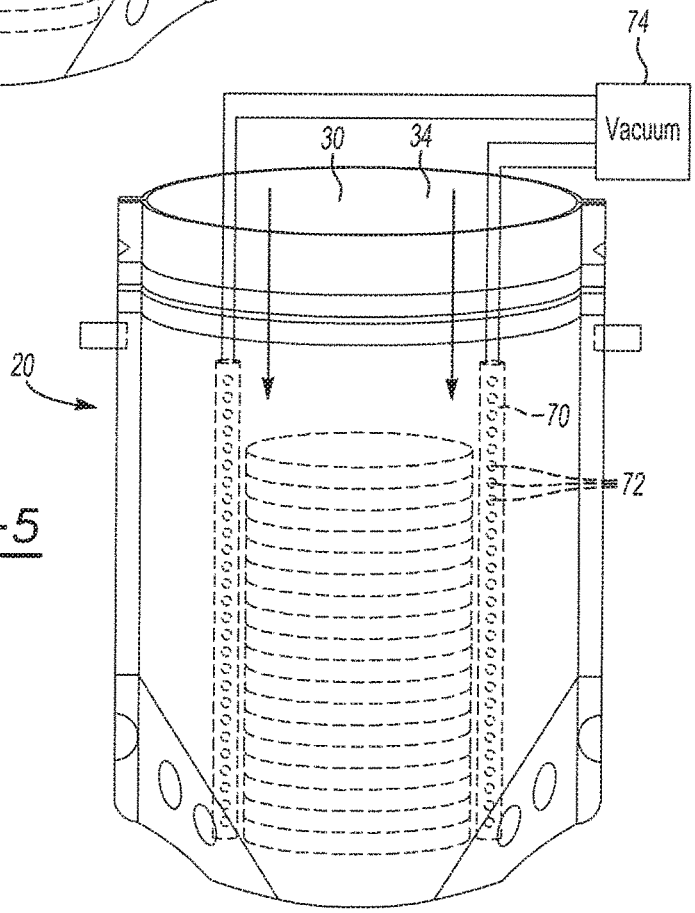
FIG. 5 illustrates a frontal perspective view of vacuum rods being inserted into the pouch to remove air from the pouch.

The next process in the assembly is vacuum sealing of the pouch 20. FIGS. 5 and 6 illustrate vacuum rods 70 being inserted to the pouch 20. The vacuum. rods 70 are inserted into the opening 34 of the pouch 20. The vacuum rods are connected to a vacuum 74. The vacuum rods 70 include a plurality of apertures 72 extending along the outer surface of the vacuum rod 70. The vacuum 74 then sucks the air through the apertures 72 to remove the air from the interior of the pouch 20, As the air is removed from the interior of the pouch 20, the rods 70 are slowly removed from the interior of the pouch 20. As the rods 70 are removed from the pouch 20, care is taken to seal the pouch to prevent any air from entering the interior of the pouch 20 before the pouch 20 is sealed. p FIGS. 7-10 illustrate the pouch 20 having a frangible seal 80 disposed on either side of the stack 26. The frangible seal 80 is created on the pouch to prevent any further movement of the stack 26. Although the vacuum seal created by the vacuum rods 70, as shown in FIGS. 5 and 6, prevent any movement of the stack during transportation, the pouch does not prevent movement of the stack after the vacuum seal has been broken by the user.

Figure 8:
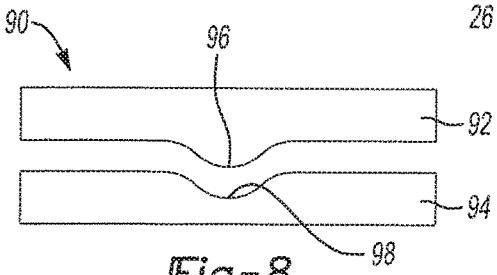
FIG. 8 illustrates a cross sectional view of the tool utilized to create the frangible seal as shown in FIG. 7.
Figure 9:
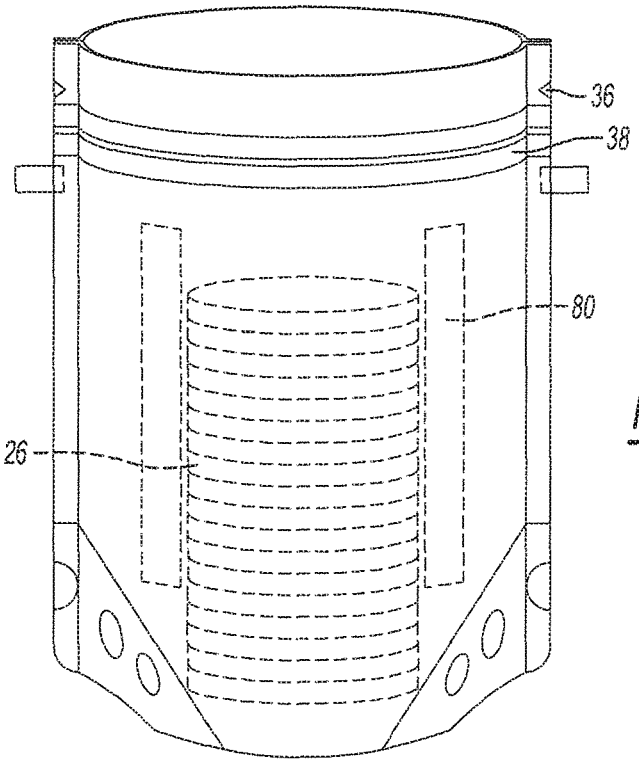
FIG. 9 illustrates a frontal perspective view of the pouch having the frangible seal on either side of the stack of hamburger patties.
Figure 10:
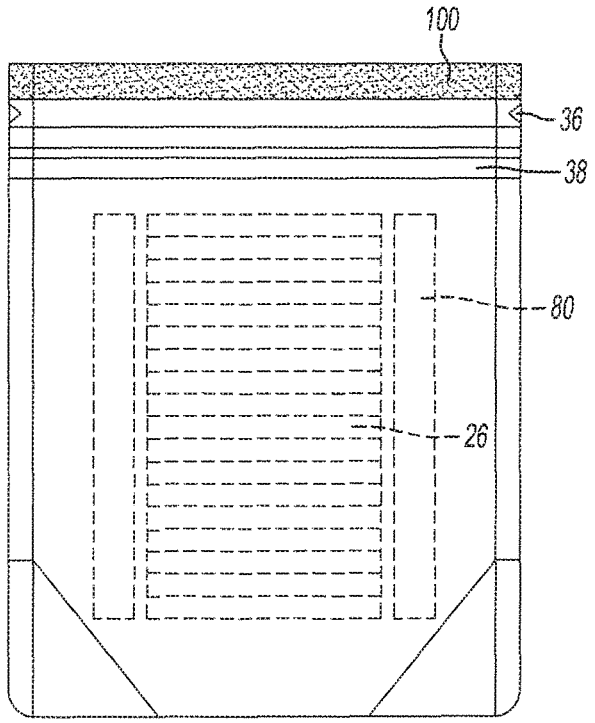
FIG. 10 illustrates a frontal view of the pouch having a frangible seal.

The frangible seal 80 prevents movement of the stack after the user has broken the vacuum seal. The frangible seal, by nature, may also be broken if the user chooses. The frangible seal 80 is created by an apparatus similar to the one as shown in FIG. 8. The seal generally extends the length and height of the stack 26. The apparatus 90 as shown in FIG. 8 includes an upper plate 92 and a lower plate 94 wherein the upper plate 92 includes a protrusion 96 and the lower plate 94 includes an indentation 98. The protrusion 96 and the indentation 98 fit together within one another to create the frangible seal 80. One or both of the plates 92, 94 need be heated to further the seal 80. FIG. 10 further shows a top seal 100 created in a similar manner as the frangible seal 80. The top seal 100 may be provided to further prevent air from disrupting the vacuum seal. In this manner, the vacuum 74 and sealing 90 steps occur following the pouch being deposited upon an outlet conveyor 24, following which a finished sealed package27 is deposited upon a further removal conveyor 22 (again FIG. 1).

As previously described, the present apparatus packages patties into a flexible pouch, the apparatus including a stacker, the stacker having two side members operable to lift a plurality of patties received from a first conveyor. The apparatus further including a patty holder, the patty holder positioned adjacent to the stacker, the patty holder having two side members operable to lower the plurality of patties into a flexible pouch. A vacuum is further positioned adjacent to the patty holder, the vacuum operable to remove the air from the flexible pouch. A frangible seal creator is also provided operable to create a frangible seal on the flexible pouch. The stacker includes a biasing member extending between the pair of side members. The pair of side members each include a lower bracket to hold the plurality of patties. The vacuum includes a free end having an elongated rod having a plurality of apertures in fluid communication with both the vacuum and the interior of the flexible pouch. A gripper is further provided to hold the flexible pouch in an open position.

The invention is not restricted to the illustrated examples and embodiments as described above and are not intended as limitations on the scope of the invention. The methods, apparatus, compositions, and the like described herein are exemplary and not intended as limitations on the scope of the invention. Changes therein and other uses will occur to those skilled in the art.

The invention claimed is:

1. An apparatus for packaging items into a flexible pouch, the apparatus comprising:

a stacker operable to aggregate the items into a stacked plurality and to lift the items from a first conveyor;

an item holder, the item holder positioned adjacent to the stacker and receiving the stacked plurality of items so that the items are directly supported one upon another, the item holder having two side members which bias against opposite sides and along a height of the stacked plurality of items, the side members including pivotally interconnecting bottom retaining portions for supporting the stacked plurality during transfer from the first conveyor, the item holder being operable to lower the plurality of items into the flexible pouch, following which the retaining portions being actuated to release the stacked plurality of items and the item holder withdrawn from within the pouch;

a vacuum sealing component operable to remove the air from within the flexible pouch; and a frangible seal creator operable to create a frangible seal on the flexible pouch.

2. The apparatus of claim 1, the item holder further comprising a biasing member extending between the pair of side members for applying the bias against the opposite sides of the members for assisting in retaining the stacked plurality of items prior to release within the pouch.

3. The apparatus of claim 2, the bottom retaining portions each further comprising a lower bracket.

4. The apparatus of claim 1, the vacuum sealing component further comprising at least one elongated rod adapted to being inserted within the pouch, the rod being in communication with a vacuum source for withdrawing air through at least one air withdrawal aperture.

5. The apparatus of claim 4, the rod further comprising a plurality of apertures in fluid communication with both the vacuum source and the interior of the flexible pouch to permit progressive withdrawal of the rod from the pouch during sealing thereof.

6. The apparatus of claim 1, further comprising a gripper for holding the flexible pouch in an open position prior to insertion of the item holder and stacked plurality of items.

7. An assembly for packaging a plurality of patty shaped items into a flexible and sealable pouch, comprising:

a first conveyor transporting the items to a stacker operable to aggregate the items into a stacked plurality, the stacker conveying the items from the first conveyor;

an item holder positioned adjacent to the stacker and receiving therefrom the stacked plurality of items so that the items are directly supported one upon another, the item holder having a pair of side members biasing against opposite sides and along a height of the stacked plurality of items, pivotally interconnected bottom retaining members extending from the side members for supporting the items during transfer by the item holder to the pouch, the item holder releasing the stacked plurality of items within the pouch and prior to being withdrawn from the pouch; and a vacuum sealing component operable to remove the air from within the pouch.

8. The assembly as described in claim 7, further comprising a frangible seal creator operable to create a frangible seal in the flexible pouch to prevent movement of the stacked items.

9. The assembly as described in claim 8, said frangible seal creator further comprising an upper plate having a protrusion and a lower plate having an opposing indentation which fit together to create the seal.

10. The assembly as described in claim 8, further comprising an outlet conveyor for communicating the pouch and deposited stacked plurality of items in succession to said vacuum sealing component and said frangible seal creator.

11. The assembly as described in claim 10, further comprising a removal conveyor in communication with an outlet location of said outlet conveyor for removal of vacuum sealed pouches.

12. The assembly according to claim 7, further comprising a spring member extending between said side members for biasing against the opposite sides of the stacked plurality of items by influencing said side members towards one another and in retaining fashion against opposite sides of the stacked plurality of items.

13. The assembly as described in claim 7, the vacuum sealing component further comprising at least one elongated rod adapted to being inserted within the pouch, the rod being in communication with a vacuum source for withdrawing air through at least one air withdrawal aperture.

14. The assembly as described in claim 13, said rod further comprising a plurality of apertures in fluid communication with said vacuum source and the interior of the flexible pouch to permit progressive withdrawal of said rod from the pouch during sealing thereof.

15. The assembly as described in claim 14, further comprising a gripper for holding the flexible pouch in an open position prior to insertion of said item holder and stacked plurality of items.

* * * * *